US009441855B2

(12) United States Patent
Marks

(10) Patent No.: US 9,441,855 B2
(45) Date of Patent: Sep. 13, 2016

(54) ADAPTABLE HVAC UNIT BASE

(71) Applicant: TRANE INTERNATIONAL INC., Piscataway, NJ (US)

(72) Inventor: Jeffrey Charles Marks, Clarksville, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 155 days.

(21) Appl. No.: 14/158,294

(22) Filed: Jan. 17, 2014

(65) Prior Publication Data

US 2014/0196495 A1 Jul. 17, 2014

Related U.S. Application Data

(60) Provisional application No. 61/753,733, filed on Jan. 17, 2013.

(51) Int. Cl.
*F24F 7/007* (2006.01)
*F24F 13/32* (2006.01)

(52) U.S. Cl.
CPC ..... *F24F 13/32* (2013.01); *F24F 2221/16* (2013.01)

(58) Field of Classification Search
CPC ..... F24F 7/007; F24F 13/32; F24F 2221/16; F24F 7/00; F24F 7/02; F24F 7/025; F24F 2221/00; F24F 2221/50
USPC ..... 62/426; 454/237
See application file for complete search history.

(56) References Cited

U.S. PATENT DOCUMENTS

| | | | | | |
|---|---|---|---|---|---|
| 3,984,224 | A | * | 10/1976 | Dawkins | 62/89 |
| 4,051,691 | A | * | 10/1977 | Dawkins | 62/236 |
| 4,413,450 | A | | 11/1983 | Brower | |
| 5,307,645 | A | * | 5/1994 | Pannell | 62/244 |
| 5,393,224 | A | | 2/1995 | Allen et al. | |
| 5,522,768 | A | * | 6/1996 | Brodt et al. | 454/234 |
| 5,595,068 | A | * | 1/1997 | Amr | 62/418 |
| 5,647,175 | A | | 7/1997 | Smyth | |
| 5,687,514 | A | | 11/1997 | Gillispie | |
| 5,832,674 | A | | 11/1998 | Ledbetter et al. | |
| 6,116,037 | A | * | 9/2000 | Burnett | 62/239 |
| 6,151,838 | A | | 11/2000 | Husein | |
| 6,295,826 | B1 | * | 10/2001 | Lee | 62/244 |
| 7,086,171 | B2 | | 8/2006 | Lawson | |
| 7,162,884 | B2 | * | 1/2007 | Alles | 62/178 |

(Continued)

*Primary Examiner* — Mohammad M Ali
(74) *Attorney, Agent, or Firm* — Hamre, Schumann, Mueller & Larson, P.C.

(57) ABSTRACT

An adaptable base of the HVAC unit can allow an HVAC unit to align and seal with multiple duct opening configurations. Such opening configurations may be different footprints in different HVAC systems, such as may be employed for example in different roof curbs of rooftop HVAC units. The adaptable base includes a base plate, a supply air duct opening, a return air duct opening, where there is at least one additional opening for one or both of the supply air opening and the return air duct opening. Each opening has a seal around its perimeter. A seal is also arranged and located on the base plate about a perimeter around the supply air duct opening(s) and the return air duct opening(s). A cover can be connected to close one or more openings that are not being used with the unit.

14 Claims, 7 Drawing Sheets

(56) References Cited

U.S. PATENT DOCUMENTS

| | | | | |
|---|---|---|---|---|
| 7,891,573 | B2 | 2/2011 | Finkam et al. | |
| 8,210,488 | B2 | 7/2012 | Small | |
| 8,282,452 | B2 | 10/2012 | Grigsby et al. | |
| 2005/0116055 | A1* | 6/2005 | Alles | 236/49.1 |
| 2006/0130406 | A1* | 6/2006 | Yoshida et al. | 49/352 |
| 2006/0174560 | A1 | 8/2006 | Levine et al. | |
| 2008/0022615 | A1 | 1/2008 | Fox | |
| 2008/0203866 | A1* | 8/2008 | Chamberlain | F24F 1/0007 312/236 |
| 2008/0250800 | A1* | 10/2008 | Wetzel | 62/179 |
| 2010/0006258 | A1* | 1/2010 | Richter et al. | 165/61 |
| 2010/0112930 | A1 | 5/2010 | Grigsby et al. | |
| 2010/0300650 | A1* | 12/2010 | Bean, Jr. | 165/67 |

* cited by examiner

ADAPTABLE HVAC UNIT BASE

FIELD OF TECHNOLOGY

Heating, ventilation and air conditioning (HVAC) units are described. In particular, HVAC units described herein are to embodiments and aspects of an adaptable base that allows an HVAC unit to align with multiple duct opening configurations. In particular, the adaptable base can align with multiple duct configurations, such as by aligning and sealing with return and supply duct(s), which may be employed for example in different roof curbs of rooftop HVAC units.

BACKGROUND

A HVAC system can include components such as a compressor or pump, one or more heat exchangers, and one or more fans to allow for return and supply air to appropriately move through the system. Some or more of these components can make up an HVAC unit, such as may be employed in a rooftop HVAC application. Such HVAC units are installed differently. For example, some light commercial HVAC rooftop units are installed on a roof curb which supports the unit on the roof, seals the perimeter of the unit, and provides a means to connect building ductwork to the unit base return and supply openings. The footprint and the design of such roof curbs can tend to be unique to a certain manufacturer or product.

SUMMARY

Systems, apparatuses, and methods herein are to HVAC units directed to embodiments and aspects of an adaptable base of the HVAC unit, which can allow an HVAC unit to align with multiple duct opening configurations. Such opening configurations may be different footprints in different HVAC systems. In particular, the adaptable base can align with multiple duct configurations, such as by aligning and sealing with return and supply duct(s), which may be employed for example in different roof curbs of rooftop HVAC units.

Generally, the adaptable base has multiple openings to accommodate the return air and the supply air duct openings of multiple HVAC systems. Typically, the return air and supply air duct openings can dictate the layout or footprint, for example of a rooftop unit. A roof curb is often used as the basic footprint for the unit. Such roof curbs can be different depending on the HVAC product or its manufacturer.

In one embodiment, the adaptable base includes a base plate, a supply air duct opening, a return air duct opening, where there is at least one additional opening for one or both of the supply air opening and the return air duct opening. Each opening has a seal around its perimeter. A supply side/return side seal may be included on the base plate between the supply air duct opening(s) and the return air duct opening(s). A seal is also arranged and located on the base plate about a perimeter around the supply air duct opening(s) and the return air duct opening(s) and can be coordinated with the supply side/return side seal. In some embodiments, a cover can be connected to close one or more openings that are not being used with the unit, such as for example to accommodate a supply duct opening and return duct opening of a different HVAC footprint, e.g. its roof curb.

In one embodiment, there are multiple return openings that can fit multiple roof curbs and duct work. Cover panel(s) may be used to cover an unused opening(s).

In one embodiment, a method to install the adaptable base above can include adapting the base to cover and/or uncover certain supply air duct opening(s) and/or return air duct opening(s) so as to align and seal the openings with the HVAC unit to which the adaptable base is connected.

In general, the adaptable base is capable of accommodating multiple unique HVAC unit footprints and corresponding roof curbs without the use of additional adapters. In particular, the adaptable base allows a single HVAC unit to fit multiple roof curb designs without requiring an adapter curb, such as may be employed in certain rooftop HVAC units.

Other features and aspects of the embodiments will become apparent by consideration of the following detailed description and accompanying drawings.

DETAILED DESCRIPTION

A HVAC system can include components such as a compressor or pump, one or more heat exchangers, and one or more fans to allow for return and supply air to appropriately move through the system. Some or more of these components can make up an HVAC unit, such as may be employed in a rooftop HVAC application. Such HVAC units are installed differently. For example, some light commercial HVAC rooftop units are installed on a roof curb which supports the unit on the roof, seals the perimeter of the unit, and provides a means to connect building ductwork to the unit base return and supply openings. The footprint and the design of such roof curbs can tend to be unique to a certain manufacturer and/or product. Since manufacturers tend to have unique footprints and corresponding duct sizes and locations, a typical unit can only be replaced by another unit if it fits the existing roof curb. If it does not fit, a separate structure, such as an adapter curb must be added to align the new unit base openings to the old roof curb duct work. This can add cost, can increase the resulting installed height of the unit, and availability of such adapter curbs can be limited, which can affect downtimes and/or service times for a particular unit that may have a service need or replacement.

Systems, apparatuses, and methods herein are to HVAC units directed to embodiments and aspects of an adaptable base of the HVAC unit, which can allow an HVAC unit to align with multiple duct opening configurations. Such opening configurations may be different footprints in different HVAC systems. In particular, the adaptable base can align with multiple duct configurations, such as by aligning and sealing with return and supply duct(s), which may be employed for example in different roof curbs of rooftop HVAC units.

Generally, the adaptable base has multiple openings to accommodate the return air and the supply air duct openings of multiple HVAC systems. Typically, the return air and supply air duct openings can dictate the layout or footprint, for example of a rooftop unit. A roof curb is often used as the basic footprint for the unit. Such roof curbs can be different depending on the HVAC product or its manufacturer.

Figure 1:
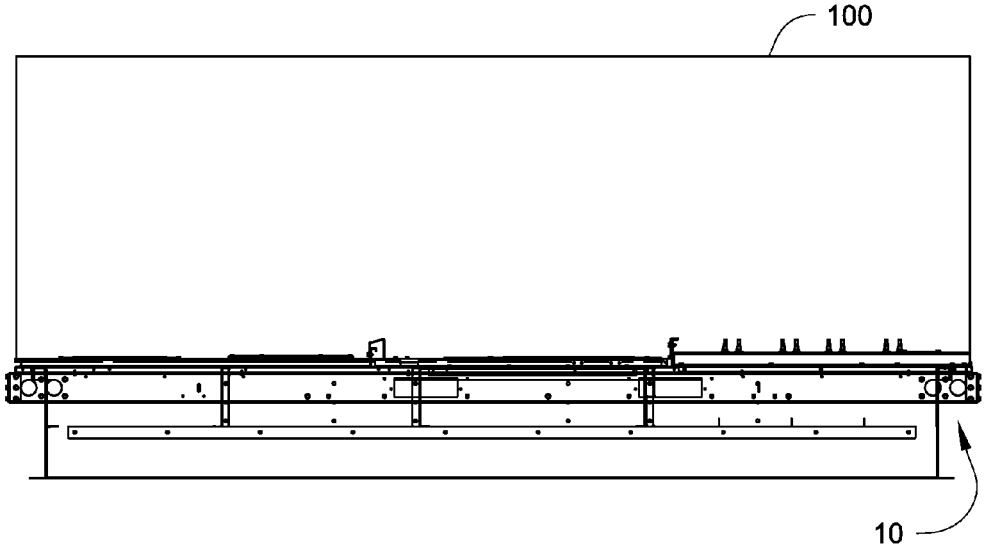
FIG. 1 shows a side view of one embodiment of a HVAC unit with one embodiment of an adaptable base.

FIG. 1 shows a side view of one embodiment of a HVAC unit 100 that has an adaptable base 10. Details of the adaptable base 10 are described below and shown in more detail in FIGS. 2 to 7.

Figure 2:
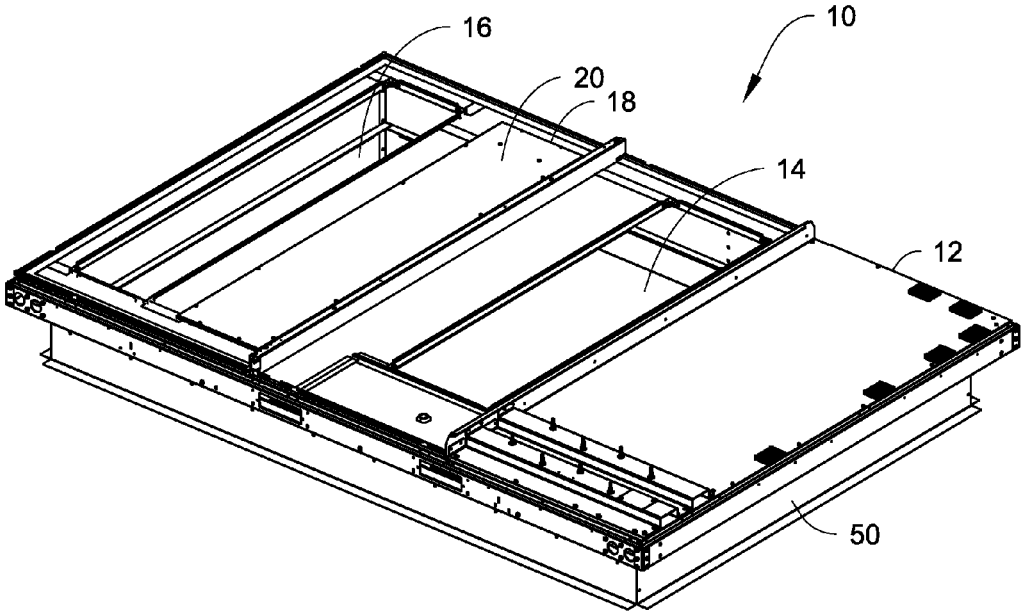
FIG. 2 shows a perspective top view of the adaptable base of FIG. 1 connected to one example of a HVAC roof curb.
Figure 3:
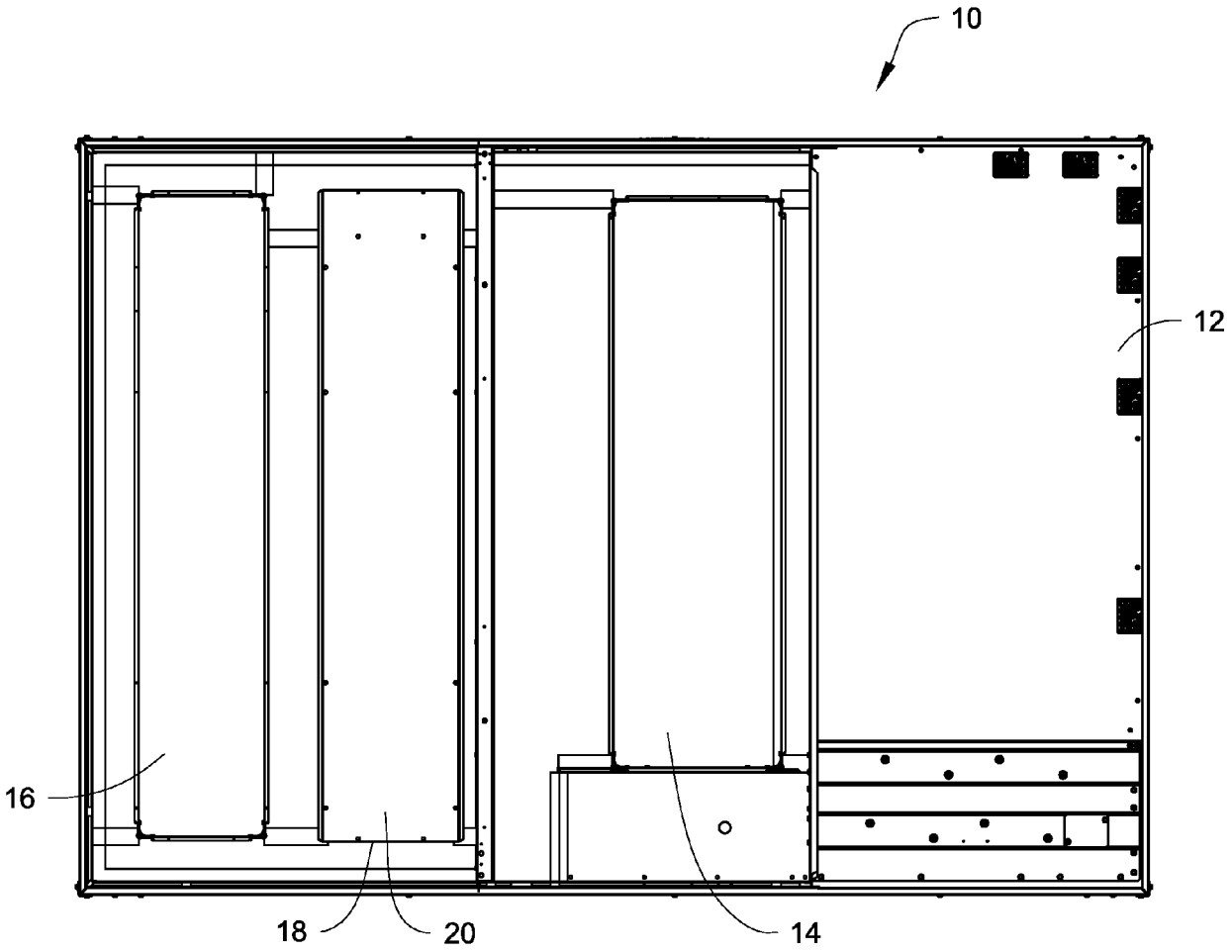
FIG. 3 shows a top view of the adaptable base of FIG. 1.
Figure 4:
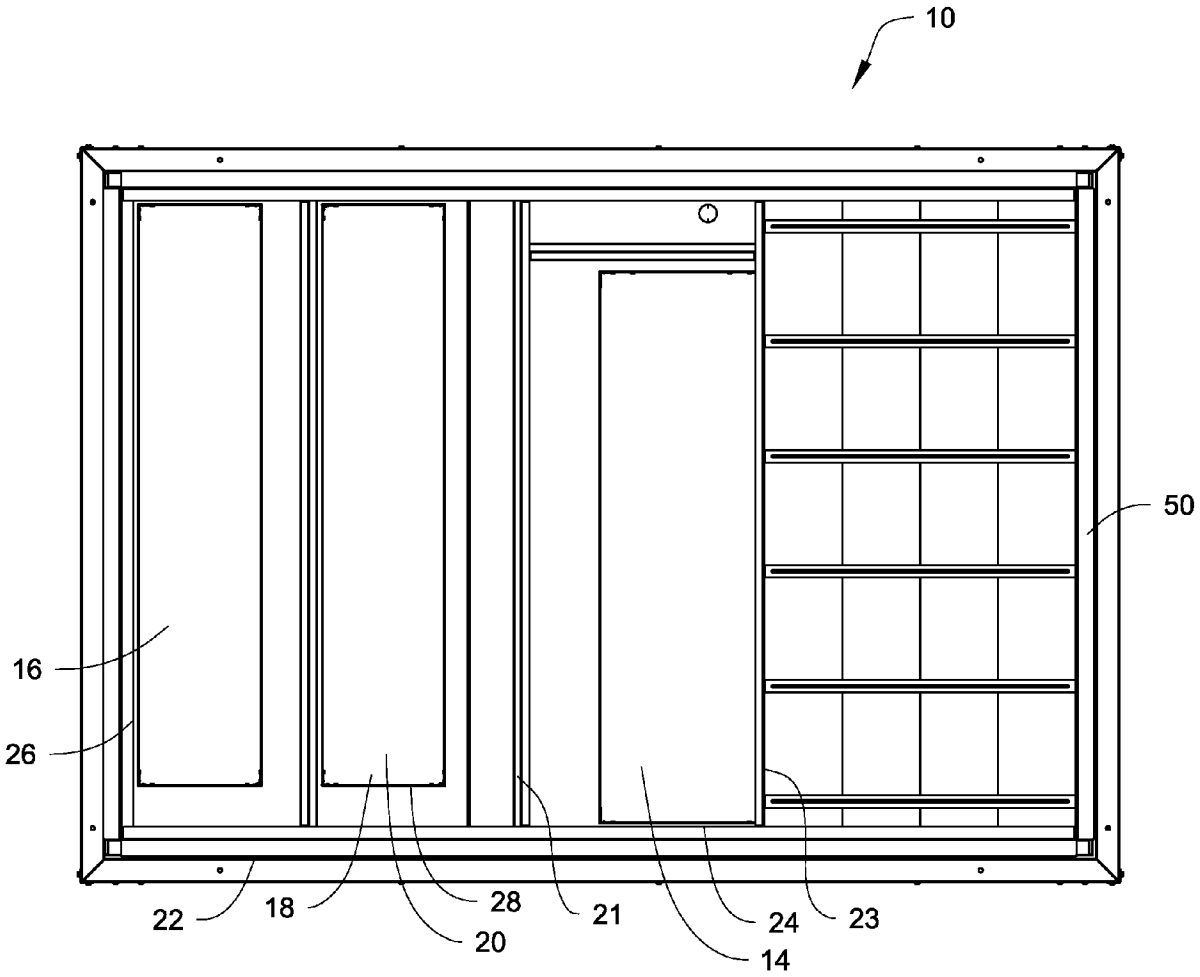
FIG. 4 shows a partial bottom view of the adaptable base of FIG. 1 and connected to the HVAC roof curb shown FIG. 2.

FIGS. 2 to 4 show the adaptable base of FIG. 1 connected to one example of a HVAC roof curb 50. In one embodiment, the adaptable base 10 includes a base plate 12, which forms a perimeter. A supply air duct opening 14 and a return air duct opening 16 extend through the base plate 12. As shown in FIGS. 2 to 4, there is at least one additional opening 18 for the return air side, such that two return air duct openings are shown 16, 18.

It will be appreciated that the additional opening(s) can be on one or both of the supply air side and return air side of the base 10. For example, there may be an additional opening for the supply air side and no additional return air duct opening 18 on the return air, or there may be an additional opening on the supply air side, while also including the additional return air duct opening 18. It will also be appreciated that there can be more than two openings on either or both of the supply air side and the return air side.

Figure 5:
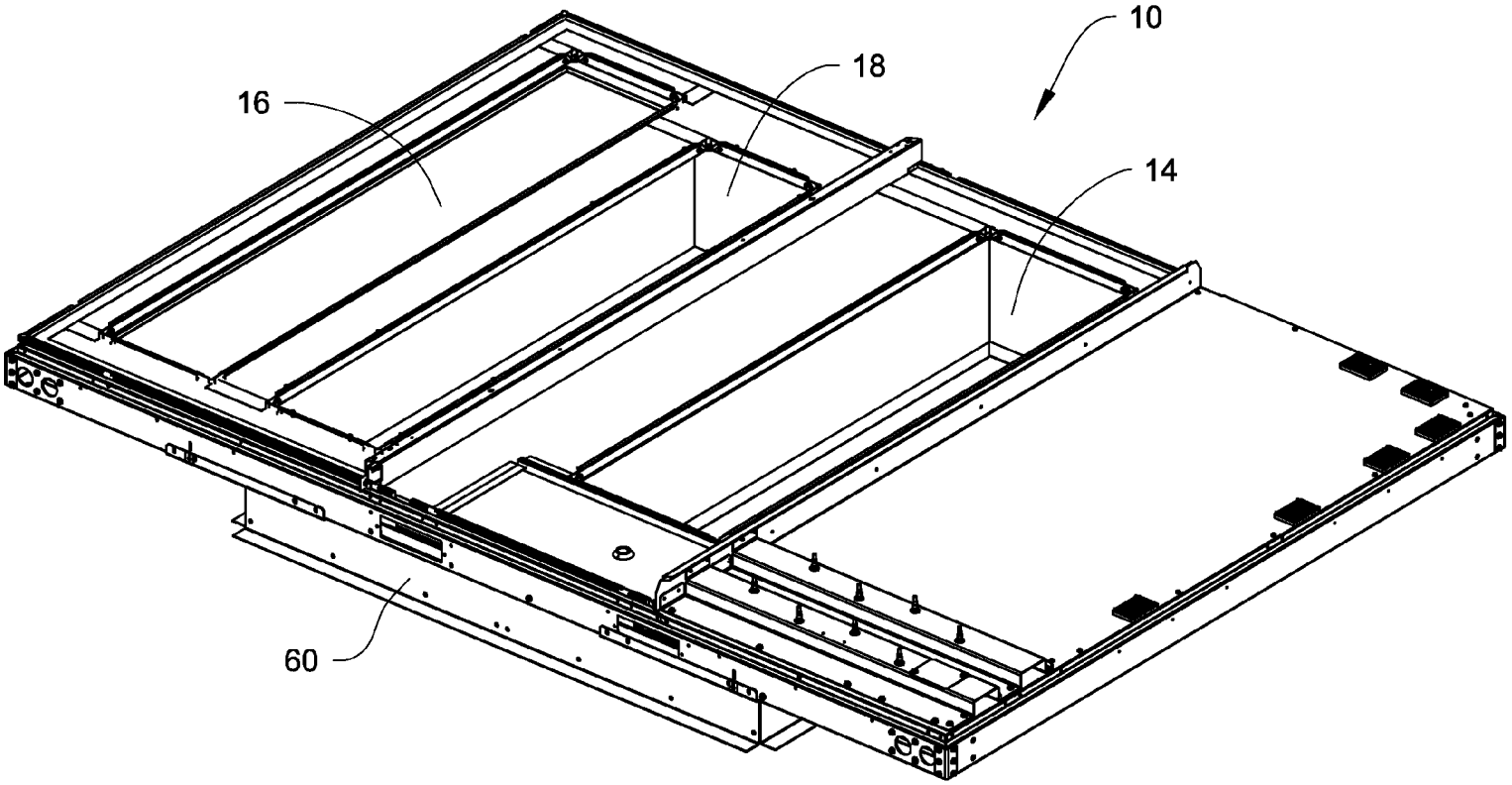
FIG. 5 shows another top perspective view of the adaptable base of FIG. 2 but connected to another example of a HVAC roof curb.
Figure 6:
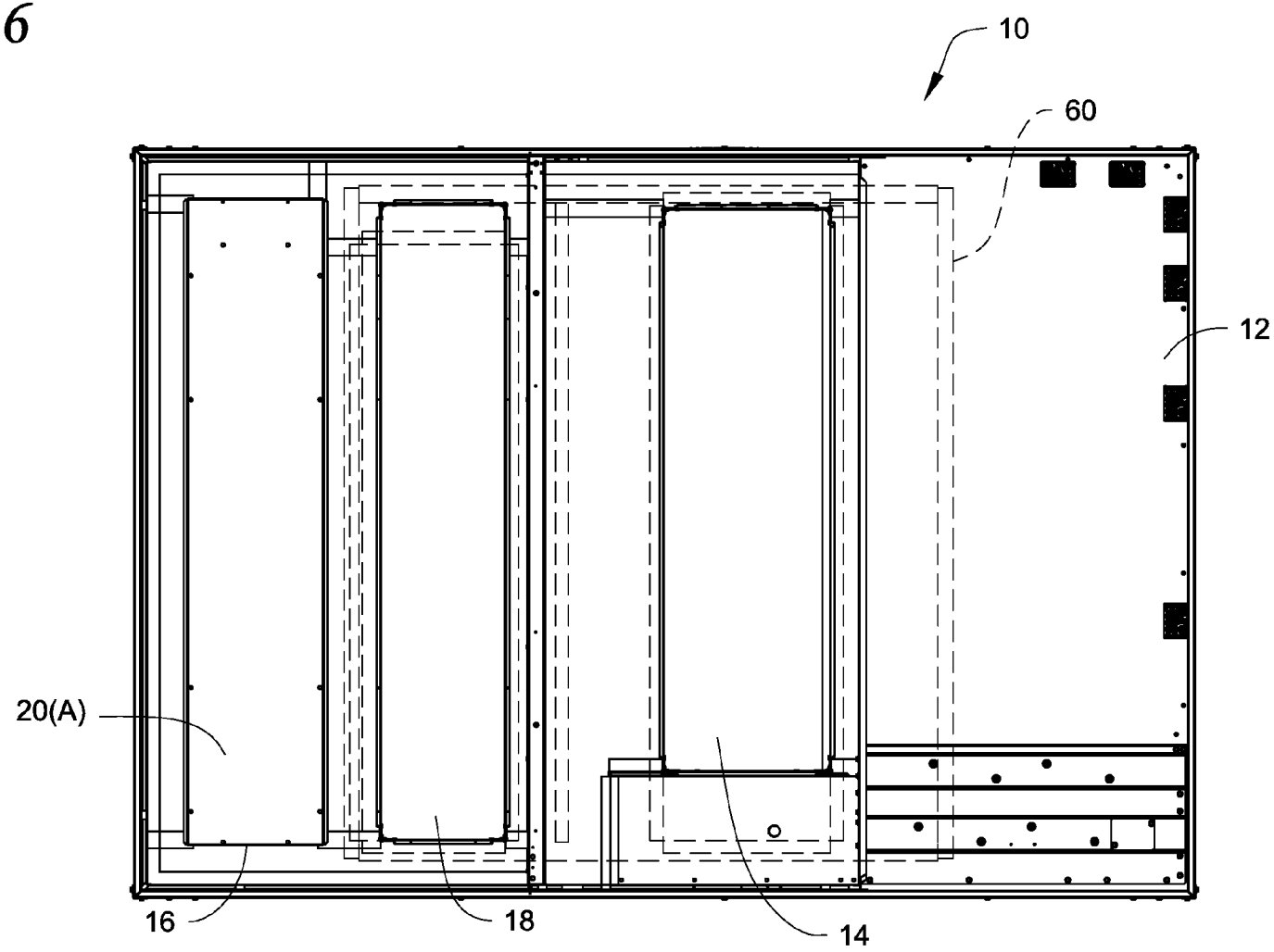
FIG. 6 shows another top view of the adaptable base of FIG. 1.
Figure 7:
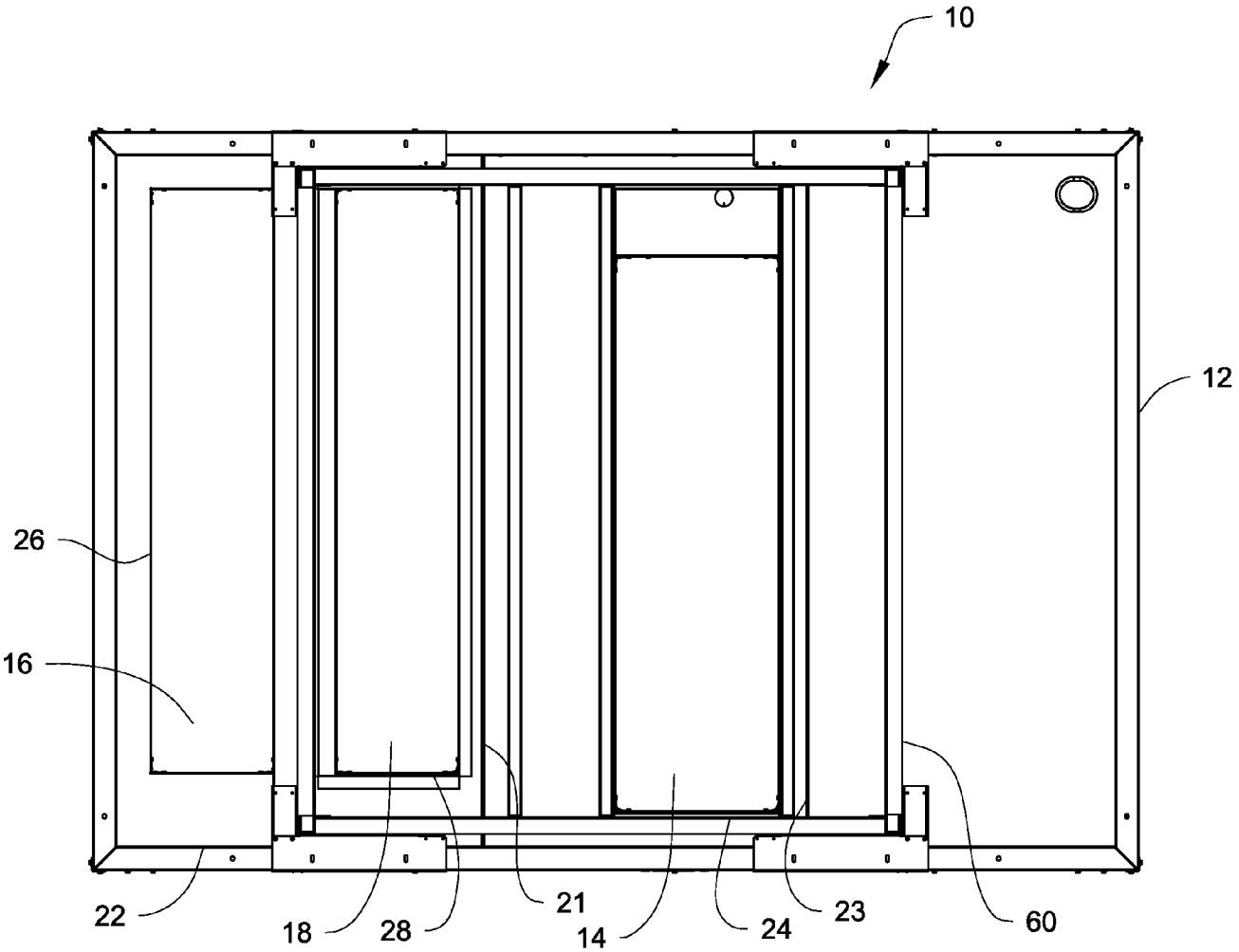
FIG. 7 shows another partial bottom view of the adaptable base of FIG. 1 and connected to the HVAC roof curb shown in FIG. 5.

In some embodiments, a cover 20 is used to cover the appropriate opening that is not being used with the HVAC unit, for example when the HVAC unit is to connect to a roof curb, e.g. 50 that does not align with the opening. As shown, opening 18 is covered by cover 20 as it does not align with the roof curb 50. It will be appreciated, such as shown in FIGS. 5 to 7, that the other openings can be covered when the HVAC unit with its base 10 is to be applied to another roof curb. It will be appreciated that more than one cover can be used and can be appropriately sized to cover the opening intended. The use of the cover(s) can provide convertible functionality to the openings of the base 10 which allow for the base 10 to be used with multiple HVAC footprints, e.g. different roof curbs.

Generally, the base 10 is also configured to appropriately seal and align with the HVAC footprint to which the unit, e.g. 100, is installed, for example to a roof curb of the HVAC system. Thus, it will be appreciated that the openings, e.g. 14, 16, 18, or other openings that may be included, can be sized appropriately to obtain desired adaptability, along with their respective covers if used.

As shown in FIG. 4, each opening 14, 16, and 18 has a seal 24, 26, 28 around its respective perimeter. The seals 24, 26, and 28 can seal each respective opening 14, 16, and 18 to the duct opening, such as on a roof curb, e.g. roof curb 50. A supply side/return side seal 21 may be included on the base plate 12 to seal between the supply air duct opening(s) and the return air duct opening(s). Seals 22, 23 are also arranged and located on the base plate 12 about a perimeter around the supply air duct opening(s) and the return air duct opening(s) and can be coordinated with the supply side/return side seal 21 to suitably seal the supply air side openings from the return air side openings and to seal the openings from the environment external to the base 10 and unit (e.g. 100). Generally, the seals may vary as needed, but are generally employed to seal the base 10 to the footprint of the HVAC system, such as the roof curb, and to seal the perimeter of the roof curb from the external environment, such as on base rails which may be located at the perimeter of the base plate 12. Any one or more of the seals in some embodiments may be a gasket disposed at appropriate locations on the base plate 12.

FIGS. 5 to 7 show the adaptable base of FIG. 2 but connected to another example of a HVAC roof curb 60. As shown, the other return air duct opening 18 is employed, while the return air duct opening 16 is not used, and may be closed by an appropriate cover, e.g. 20A, as shown in FIG. 6. The same supply air duct opening 14 is used, however, as described above, the base 10 may be constructed, arranged, or otherwise configured to have multiple openings including on the supply side to have the desired adaptability. Similar seals 24, 26, 28 may be on the plate 12, but where seal 26 would not be used in operation, since the opening 16 is not used. In the embodiment shown, FIG. 7 for example shows seals 24, 28, 21 and portions of 22 and 23 may be employed to suitably seal the base 10 to the roof curb 60.

Figure 8A:
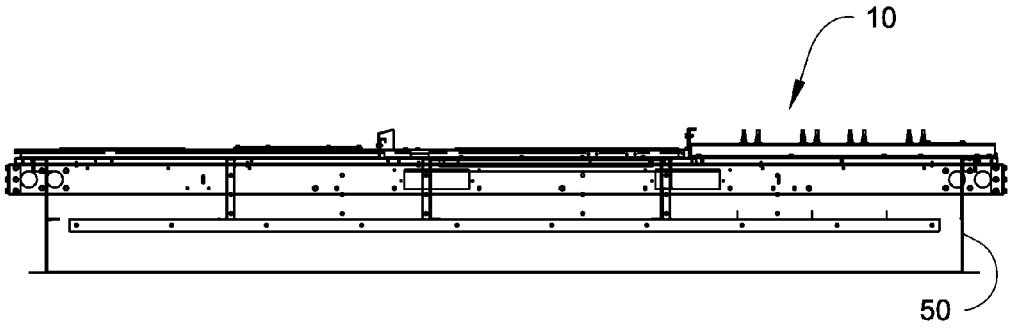
FIG. 8A shows a side view of the adaptable base of FIG. 1 and connected to the HVAC roof curb of FIG. 2.
Figure 8B:
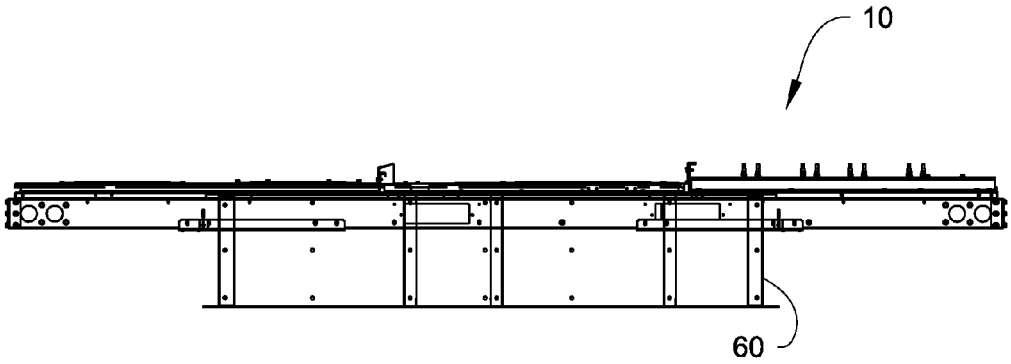
FIG. 8B shows a side view of the adaptable base of FIG. 1 and connected to the HVAC roof curb of FIG. 5.
Figure 8C:
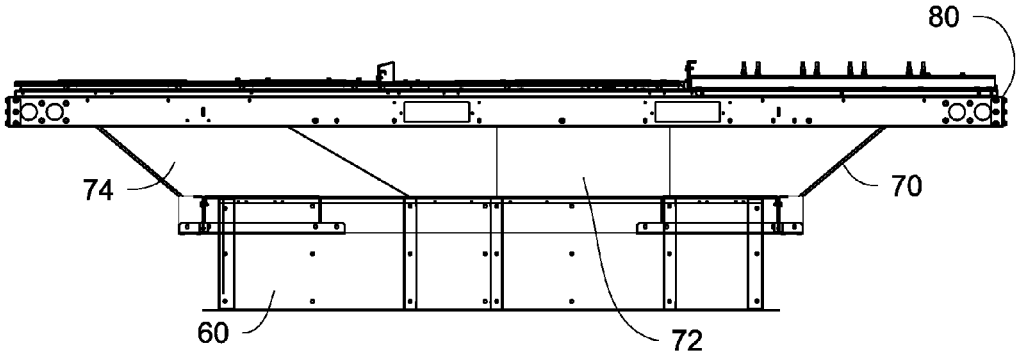
FIG. 8C shows a side view of a base that is not adaptable and uses an adapter curb to connect to the HVAC roof curb of FIG. 5.

FIGS. 8A to 8C show a comparison of the adaptable base 10 being useable with multiple roof curbs 50, 60, while base 80 is not adaptable and requires a separate adapter curb 70.

FIG. 8A shows a side view of the adaptable base 10 of FIG. 1 and connected to the HVAC roof curb 50 of FIG. 2. As shown, for example, the base plate 12 is connectable to the roof curb 50, where the roof curb 50 has a perimeter that extends proximate the perimeter of the base plate 12 and has about the same perimeter as the base plate 12. See also e.g. FIGS. 2 and 4.

FIG. 8B shows a side view of the adaptable base 10 of FIG. 1 and connected to the HVAC roof curb 60 of FIG. 5. As shown, for example, the base plate 12 is connectable to a roof curb 60, where the roof curb 60 has sides that do not extend proximate the perimeter of the base plate 12 and where the roof curb is substantially smaller than the perimeter of the base plate 12. See also e.g. FIGS. 5-7.

FIG. 8C shows a side view of a base 80 that is not adaptable and uses an adapter curb 70 to connect to the HVAC roof curb 60 of FIG. 5. As shown, the adapter curb 70 includes flow passages 72, 74 to align with the supply air side duct openings and return air side openings. The adapter curb 70 adds height to the overall unit, in some cases as high as 12 to 14 inches, may not be readily available, and can add cost.

The embodiments herein are designed to allow a base of an HVAC unit to have an interface to align and seal with multiple return and/or supply base openings which allow the unit to accommodate multiple roof curb designs. The base openings, whether on the supply side and/or the return side are sized and located such that the unit can fit roof curbs without allowing air bypass around the roof curb duct connections. The embodiments herein can allow a base of a single unit to be used with multiple footprints, e.g. and their corresponding roof curbs without the need for an adapter curb to align base openings to roof curb duct work.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

The invention claimed is:

1. A base of a heating, ventilation, air conditioning (HVAC) unit, comprising:

a base plate;

a supply air duct opening through the base plate;

a return air duct opening through the base plate;

at least one additional opening designated as one of another supply air opening through the base plate and another return air duct opening through the base plate;

a seal disposed about and along a perimeter of the base plate on a top side of the base plate around the supply air duct opening and the return air duct opening;

a seal disposed on the top side of the base plate about the supply air duct opening;

a seal disposed on the top side of the base plate about the return air duct opening;

a seal disposed on the top side of the base plate about the at least one additional opening; and a supply side/return side seal on the top side of the base plate disposed between the supply air duct opening and the return air duct opening, wherein the base plate is configured to be adaptable to multiple footprints for an HVAC unit due to the arrangement of the supply air duct opening, the return air duct opening, the at least one additional opening, and the seals, the HVAC unit is a rooftop unit, the top side of the base plate includes an attachment portion for the rooftop unit along the perimeter of the base plate, and the seal disposed about and along the perimeter of the base plate is configured to seal between the attachment portion and the rooftop unit.

2. The base of claim 1, further comprising one or more cover panels connected to the base plate to close one or more of the supply air duct opening, the return air duct opening, and the at least one additional opening.

3. The base of claim 1, wherein the arrangement of the supply air duct opening, the return air duct opening, and the at least one additional opening are suitable and configured to connect to and align and seal with multiple roof curbs, on which the base is installed.

4. The base of claim 1, wherein the base plate is connectable to a roof curb, where the roof curb has a perimeter that extends proximate the perimeter of the base plate and the roof curb has about the same perimeter as the base plate.

5. The base of claim 1, wherein the base plate is connectable to a roof curb, where the roof curb has sides that do not extend proximate the perimeter of the base plate and where the roof curb is substantially smaller than the perimeter of the base plate.

6. The base of claim 1, wherein the supply side/return side seal and the supply air duct opening are spaced from each other, and the supply side/return side seal and the return air duct opening are spaced from each other.

7. The base of claim 1, wherein the supply side/return side seal extends along a first direction, the supply side/return side seal extends in the first direction farther than the at least one additional opening.

8. An HVAC apparatus comprising:

an HVAC unit having a pump or compressor, a heat exchanger, a fan; and a base that supports the HVAC unit, the base comprises a base plate, a supply air duct opening through the base plate, a return air duct opening through the base plate, at least one additional opening designated as one of another supply air opening through the base plate and another return air duct opening through the base plate, a seal disposed about and along a perimeter of the base plate on a top side of the base plate around the supply air duct opening and the return air duct opening, a seal disposed on the top side of the base plate about the supply air duct opening, a seal disposed on the top side of the base plate about the return air duct opening, a seal disposed on the top side of the base plate about the at least one additional opening, and a supply side/return side seal on the top side of the base plate disposed between the supply air duct opening and the return air duct opening, wherein the base plate is configured to be adaptable to connect to multiple footprints for an HVAC unit due to the arrangement of the supply air duct opening, the return air duct opening, the at least one additional opening, and the seals, the supply air duct opening, the return air duct opening, and the at least one additional opening are disposed underneath the HVAC unit, the HVAC unit is a rooftop unit that sits on the top side of the base plate, the top side of the base plate includes an attachment portion for the rooftop unit along the perimeter of the base plate, and the seal disposed about and along the perimeter of the base plate is configured to seal between the attachment portion and the rooftop unit.

9. The apparatus of claim 8, further comprising one or more cover panels connected to the base plate to close one or more of the supply air duct opening, the return air duct opening, and the at least one additional opening.

10. The apparatus of claim 8, wherein the arrangement of the supply air duct opening, the return air duct opening, and the at least one additional opening are suitable and configured to connect to and align and seal with multiple roof curbs, on which the base is installed.

11. The apparatus of claim 8, wherein the base plate is connectable to a roof curb, where the roof curb has a perimeter that extends proximate the perimeter of the base plate and the roof curb has about the same perimeter as the base plate.

12. The apparatus of claim 8, wherein the base plate is connectable to a roof curb, where the roof curb has sides that do not extend proximate the perimeter of the base plate and where the roof curb is substantially smaller than the perimeter of the base plate.

13. The apparatus of claim 8, wherein the supply side/return side seal and the supply air duct opening are spaced from each other, and the supply side/return side seal and the return air duct opening are spaced from each other.

14. The apparatus of claim 8, wherein the supply side/return side seal extends along a first direction, the supply side/return side seal extends in the first direction farther than the at least one additional opening.

* * * * *